US005527483A

United States Patent [19]

Kenkare et al.

[11] Patent Number: 5,527,483

[45] Date of Patent: Jun. 18, 1996

[54] NONAQUEOUS GELLED AUTOMATIC DISHWASHING COMPOSITION CONTAINING ENZYMES

[75] Inventors: Divaker Kenkare, Asbury; Nagaraj Dixit, Plainsboro, both of N.J.; Patrick Durbut, Verviers, Belgium

[73] Assignee: Colgate Palmolive Co., Piscataway, N.J.

[21] Appl. No.: 220,643

[22] Filed: Mar. 31, 1994

Related U.S. Application Data

[63] Continuation-in-part of Ser. No. 15,051, Feb. 8, 1993, which is a continuation-in-part of Ser. No. 928,622, Aug. 11, 1992, which is a continuation-in-part of Ser. No. 708,558, May 31, 1991, abandoned, and a continuation-in-part of Ser. No. 708,571, May 31, 1991, Pat. No. 5,240,633, and a continuation-in-part of Ser. No. 708,322, May 31, 1991, abandoned, and a continuation-in-part of Ser. No. 938,070, Aug. 31, 1992, which is a continuation-in-part of Ser. No. 797,605, Nov. 25, 1991, abandoned, which is a continuation-in-part of Ser. No. 708,566, May 31, 1991, abandoned, and a continuation-in-part of Ser. No. 837,316, Feb. 10, 1992, abandoned, which is a continuation-in-part of Ser. No. 708,320, May 31, 1991, abandoned, and a continuation-in-part of Ser. No. 833,472, Feb. 10, 1992, abandoned, which is a continuation-in-part of Ser. No. 708,321, May 31, 1991, Pat. No. 5,169,553.

[51] Int. Cl.[6] ..... C11D 3/386; C11D 3/395; C11D 3/37

[52] U.S. Cl. ..... 252/95; 252/174.12; 252/DIG. 12; 252/174.23; 435/219; 435/220; 435/221; 435/222; 435/223; 435/224

[58] Field of Search ..... 252/174.12, DIG. 12, 252/174.17, 174.23, 95; 435/219, 225

[56] References Cited

U.S. PATENT DOCUMENTS

| | | | |
|---|---|---|---|
| 4,101,457 | 7/1978 | Place et al. | 252/559 |
| 4,162,987 | 7/1979 | Maguire, Jr. et al. | 252/135 |
| 4,226,736 | 10/1980 | Bush et al. | 252/135 |
| 4,268,406 | 5/1981 | O'Brien et al. | 252/105 |
| 4,597,886 | 7/1986 | Goedhart et al. | 252/95 |
| 4,753,748 | 6/1988 | Laitem et al. | 252/99 |
| 4,919,834 | 4/1990 | Chen et al. | 252/90 |
| 4,931,217 | 6/1990 | Frankena | 252/547 |
| 4,973,419 | 11/1990 | Romeo et al. | 252/135 |
| 5,205,954 | 4/1993 | Ahmed et al. | 252/99 |
| 5,240,632 | 8/1993 | Brumbaugh et al. | 252/95 |
| 5,298,180 | 3/1994 | Dixit | 252/94 |

FOREIGN PATENT DOCUMENTS

| | | |
|---|---|---|
| 0365103 | 4/1990 | European Pat. Off. . |

*Primary Examiner*—Paul Lieberman
*Assistant Examiner*—Kery Fries
*Attorney, Agent, or Firm*—Richard E. Nanfeldt; Robert C. Sullivan; Murray Grill

[57] ABSTRACT

Nonaqueous gelled automatic dishwashing compositions containing a mixture of a protease enzyme and an amylase enzyme have been found to be very useful in the removal of protein and carbohydrate soils from dishware at operating temperatures of 100° F. to 140° F.

8 Claims, 5 Drawing Sheets

NONAQUEOUS GELLED AUTOMATIC DISHWASHING COMPOSITION CONTAINING ENZYMES

RELATED APPLICATIONS

This application is continuation in part application of U.S. Ser. No. 08/015,051 filed Feb. 8, 1993 which is in turn a continuation in part application of U.S. Ser. No. 07/928,622 filed Aug. 11, 1992 which in turn is a continuation-in-part application of U.S. Ser. No. 07/708,558 filed May 31, 1991 abandoned and also is a continuation-in-part application of U.S. Ser. No. 07/708,571 filed May 31, 1991, U.S. Pat. No. 5,240,633 and is also a continuation-in-part of U.S. Ser. No. 07/708,322 filed May 31, 1991 and is also a continuation in part of U.S. Ser. No. 07/938,070 filed Aug. 31, 1992, which in turn is a continuation in part application of U.S. Ser. No. 07/797,605 filed Nov. 25, 1991 abandoned which in turn is a continuation in part application of U.S. Ser. No. 071708, 566 filed May 31, 1991 abandoned and is also a continuation in part application of U.S. Ser. No. 07/837,316 filed Feb. 10, 1992 abandoned which in turn is a continuation in part application of U.S. Ser. No. 07/708,320 filed May 31, 1991 abandoned and is also a continuation in part application of U.S. Ser. No. 07/833,472 filed Feb. 10, 1992 abandoned which is a continuation in part application of U.S. Ser. No. 07/708,321 filed May 31, 1991, U.S. Pat. No. 5,169,553.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity at the operating temperature of the automatic dishwasher. Chemical stability is the property whereby the detergent composition containing enzymes does not undergo any significant degradation during storage. This is also known as shelf life. Activity is the property of maintaining enzyme activity during usage. From the time that a detergent is packaged until it is used by the customer, it must remain stable. Furthermore, during customer usage of the dishwashing detergent, it must retain its activity. Unless the enzymes in the detergent are maintained in a suitable environment, the enzymes will suffer a degradation during storage which will result in a product that will have a decreased initial activity. When enzymes are a part of the detergent composition, it has been found that the initial free water content of the composition should be as low a level as possible, and this low water content must be maintained during storage, since water will activate the enzymes. This activation will cause a decrease in the initial activity of the detergent composition.

After the detergent container is opened, the detergent will be exposed to the environment which contains moisture. During each instance that the detergent is exposed to the environment it could possibly absorb some moisture. This absorption occurs by components of the detergent composition absorbing moisture, when in contact with the atmosphere. This effect is increased as the container is emptied since there will be a greater volume of air in contact with the detergent, and thus more available moisture to be absorbed by the detergent composition. This will usually accelerate the decrease in the activity of the detergent composition. The most efficient way to prevent a significant decrease in this activity is to start with an initial high activity of enzyme and to use components in the dishwashing composition which have a low hygroscopicity and a low alkalinity which will minimize any losses in activity as the detergent is being stored or used.

The stability of enzymes in a nonaqueous liquid detergent can be improved by using an alkali metal silicate which has an alkali metal oxide: $XiO_2$ weight ratio greater than 1:1 and of about 1:2 to about 1:34. In addition, the individual components of the detergent composition should each have an initial free water content (unbounded water at 100° C.) of less than about 10 percent by weight, more preferably less than about 9 percent by weight, and most preferably less than 8 percent by weight. During manufacture the detergent composition may take-up moisture from the atmosphere. As a result, the moisture content of the detergent composition as it is being packaged may be greater than about 1 percent by weight, preferably less than about 4 percent by weight and most preferably less than about 3 percent by weight.

Nonaqueous liquid dishwasher detergent compositions which contain enzymes can be made more stable and to have a high activity, if the initial free water content of the detergent composition less than about 6 percent by weight, more preferably less than about 4 percent by weight and most preferably less than about 3 percent by weight. A key aspect is to keep the water (non-chemically bonded water) in the detergent composition at a minimum. It is critical that water not be added to the composition. Absorbed and adsorbed water are two types of water and comprise the usual free water bound in the detergent composition. Free water will have the affect of deactivating the enzymes. Furthermore, the pH of 1.0 weight % of an aqueous solution of a liquid detergent composition must be less than about 11.0 more preferably less than about 10.8, and most preferably less than about 10.5. This low alkalinity of the dishwashing detergent will also increase the stability of the detergent composition which contains a mixture of enzymes, thereby providing a higher initial activity of the mixture of the enzymes and the maintenance of this initial high activity.

The free water content of the dishwashing detergent compositions of the instant invention can be controlled to a large extent by using components that have a low initial water content and a low hygroscopicity. The individual components of the instant composition should have a water content of less than about 10 percent by weight, more preferably less than about 9 percent by weight, and most preferably less than about 8 percent by weight. In addition, the organic components of the dishwashing detergent composition should have low hydroxyl group content to decrease the hydrogen bonding absorption of water. In place of the carrier such as ethylene glycols or glycerols, relatively low hydroxyl content-anhydrous organics such as alcohol ethers and polyalkylene glycols can be used. In place of polyacid suspending agents normally used in liquid automatic dishwashing detergent compositions such as polyacrylic acid or salts of polyacrylic acids, there should be used polyacid/acid anhydride copolymers such as polyacrylic acid/acid anhydride copolymers. Maleic anhydride is a suitable acid anhydride. The net result is a decreased hydroxyl group content which translates to a decreased hygroscopicity of the detergent composition which helps maintain the stability and the activity.

SUMMARY OF THE INVENTION

This invention is directed to producing a gelled enzyme containing automatic dishwashing detergent compositions which have an increased chemical stability and essentially a constant activity of enzyme at wash operating temperatures of about 100° F. to about 140° F. and improved rheological properties. These properties are accomplished by controlling the viscosity in a gel form, the alkalinity and the hygroscopicity of the detergent composition and using a novel mixture of enzymes. An alkali metal silicate is used in the dishwashing detergent compositions which may have a free water content of less than about 6 percent by weight, more preferably less than about 4 percent by weight, and most preferably less than about 3 percent by weight throughout its usage. The $Na_2O:SiO_2$ ratio can exceed 1:3.22 but should not be lower than 1:2. In order to achieve this low free water content, the water content of each of the detergent components should be less than about 10 percent by weight, more preferably less than about 8 percent by weight, and most preferably less than about 6 percent by weight. Furthermore, each of the organic components should have a low hydroxyl group content in order to decrease the potential amount of hydrogen bonded water in the composition.

Conventional automatic dishwashing compositions are usually suspensions containing a low foaming surface-active agent, a carrier solvent which is usually water, a chlorine bleach, alkaline builder materials, and usually minor ingredients and additives. The incorporation of chlorine bleach requires special processing and storage precautions to protect composition components which are subject to deterioration upon direct contact with the active chlorine. The stability of the chlorine bleach is also critical and raises additional processing and storage difficulties. In addition, it is known that automatic dishwasher detergent compositions may tarnish silverware and damage metal trim on china as a result of the presence of a chlorine-containing bleach therein. Accordingly, there is a standing desire to formulate detergent compositions for use in automatic dishwashing operations which are free of active chlorine and which are capable of providing overall hard surface cleaning and appearance benefits comparable to or better than active chlorine-containing detergent compositions. This reformulation is particularly delicate in the context of automatic dishwashing operations, since during those operations, the active chlorine prevents the formation and/or deposition of troublesome protein and protein-grease complexes on the hard dish surfaces. No surfactant system currently known is capable of adequately performing this function.

Various attempts have been made to formulate bleach-free low foaming detergent compositions for automatic dishwashing machines, containing particular low foaming nonionics, builders, filler materials and enzymes. U.S. Pat. No. 3,472,783 to Smille recognized that degradation can occur when an enzyme is added to a highly alkaline automatic dishwashing detergent.

French Patent No. 2,102,851 to Colgate-Palmolive, pertains to rinsing and washing compositions for use in automatic dishwashers. The compositions disclosed have a pH of 6 to 7 and contain an amylolytic and, if desired, a proteolytic enzyme, which have been prepared in a special manner from animal pancreas and which exhibit a desirable activity at a pH in the range of 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et al, teaches a detergent composition for cleaning dishes, with a pH of from 7 to 9 containing an amylolytic enzyme, and in addition, optionally a proteolytic enzyme.

U.S. Pat. No. 4,101,457 to Place et al teaches the use of a proteolytic enzyme having a maximum activity at a pH of 12 in an automatic dishwashing detergent.

U.S. Pat. No. 4,162,987 to Maguire et al teaches a granular or liquid automatic dishwashing detergent which uses a proteolytic enzyme having a maximum activity at a pH of 12 as well as an amylolytic enzyme having a maximum activity at a pH of 8.

U.S. Pat. No. No 3,827,938 to Aunstrup et al, discloses specific proteolytic enzymes which exhibit high enzymatic activities in highly alkaline systems. Similar disclosures are found in British Patent Specification No. 1,361,386, to Novo Terapeutisk Laboratorium NS. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent how to formulate an effective gelled bleach-free automatic dishwashing compositions having improved rheological properties which is capable of providing superior performance at low alkalinity levels during conventional use.

U.S. Pat. No. Nos. 3,840,480; 4,568,476; 3,821,118 and 4,501,681 teach the use of enzymes in automatic dishwashing detergents.

The aforementioned prior art fails to provide a gelled automatic dishwashing detergent which contains a mixture of enzymes for the simultaneous degradation of both proteins and starches, wherein the combination of enzymes have a maximum activity at a pH of less than about 11.0 and the gelled automatic dishwashing detergent has optimized cleaning performance in a temperature range of about 100° F. to about 140° F.

It is an object of this invention to incorporate a unique enzyme mixture of proteolytic and amylolytic enzymes in dishwasher detergent compositions which can be used in automatic dishwashing operations capable of providing performance at operating temperatures of about 100° F. to about 140° F. as to a bleach containing compositions as well as provide compositions in a gel state which have improved theological properties.

Both protein soils and carbohydrate soils are extremely difficult to remove form dishware. The use of bleach in automatic dishwashing compositions helps in the removal of protein soils and high alkalinity of these automatic dishwashing compositions helps in the removal of carbohydrate soils, but even with bleach and high alkalinity these protein and carbohydrate soils are not completely removed. The use of a protease enzyme in the automatic dishwashing compositions improves the removal of protein soils such as egg and milk from dishware and the use of an amylase enzyme improves the removal of carbohydrate soils such as starch from dishware.

DETAILED DESCRIPTION

Figure 1:
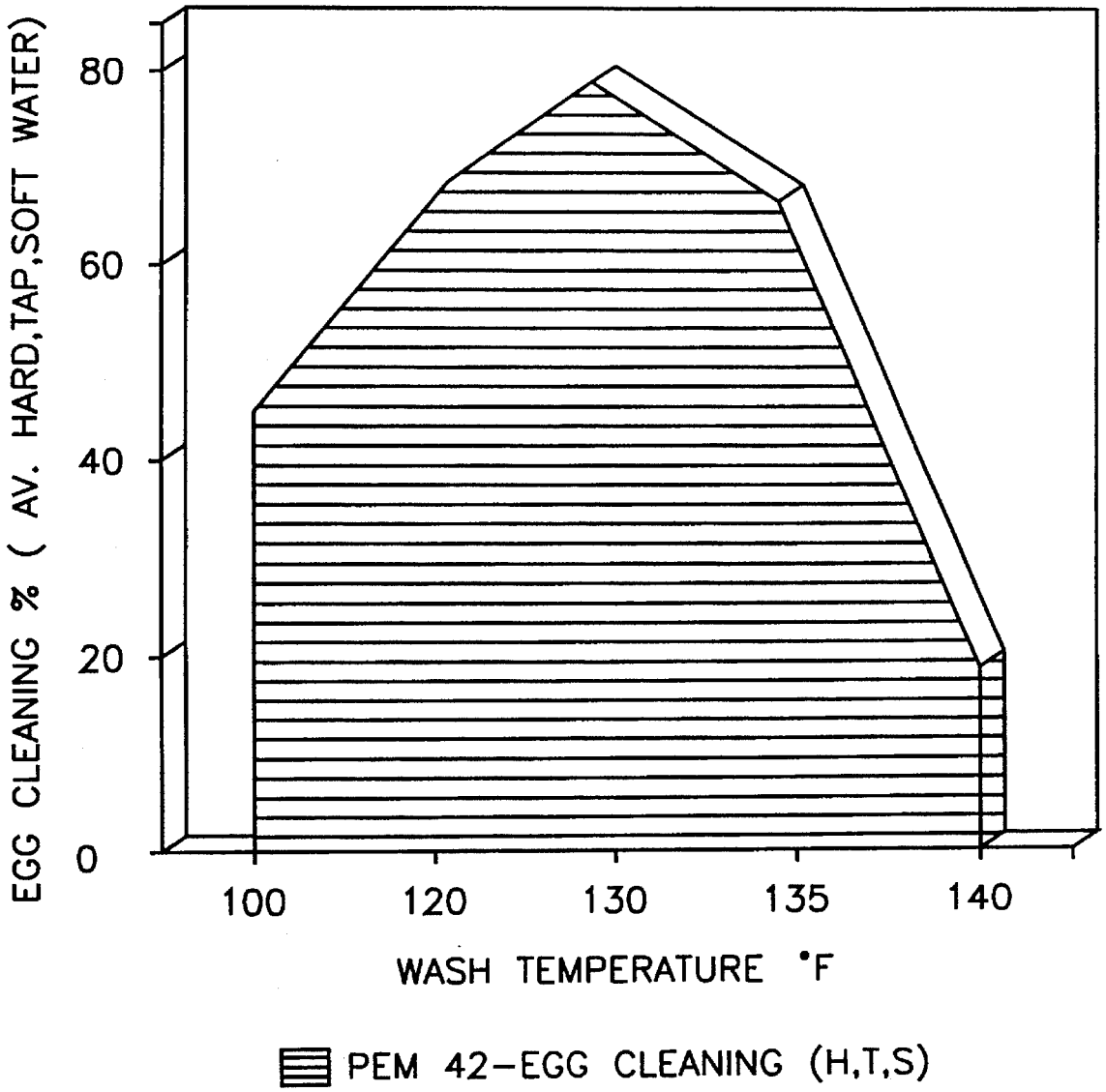
FIG. 1 illustrates a graph of a percent of egg removal at various water and temperature conditions for Protein Engineered Maxacal 42 (Maxapem 42) enzyme versus wash temperature of cleaning at a pH of 9.1.

The present invention relates to a gelled automatic dishwashing detergent compositions which comprise a nonionic surfactant, a nonaqueous liquid carrier, an alkali metal silicate, a metal inorganic builder salt, a gelling agent and a mixture of an amylase enzyme and at least one protease enzyme and, optionally, a foam depressant, and a lipase enzyme, wherein the gelled automatic dishwashing detergent composition has a pH of less than about 10.5 and the dishwashing detergent composition exhibits maximum cleaning efficiency for both proteins and starches at a wash temperature of about 100° F. to about 140° F.

The liquid nonionic surfactants that can be, optionally, used in the present gelled automatic dishwasher detergent compositions are well known. A wide variety of the these surfactants can be used.

The nonionic synthetic organic detergents are generally described as ethoxylated propoxylated fatty alcohols which are low-foaming surfactants and are possibly capped, characterized by the presence of an organic hydrophobic group and an organic hydrophilic group and are typically produced by the condensation of an 0 organic aliphatic or alkyl aromatic hydrophobic compound with ethylene oxide and/or propylene oxide. Practically any hydrophobic compound having a carboxyl, hydroxy and amido or amino group with a free hydrogen attached to the nitrogen can be condensed with ethylene oxide or with the polyhydration product thereof, polyethylene glycol, to form a nonionic detergent. The length of the hydrophilic or polyoxy ethylene/propylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low foaming polylower alkoxylated lipophiles, wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol has about 9 to about 18 carbon atoms and wherein the number of moles of lower alkylene oxide (of 2 or 3 carbon atoms) is from about 3 to about 15. Of such materials it is preferred to employ those wherein the higher alkanol is a high fatty alcohol having about 9 to about 11 or about 12 to about 15 carbon atoms and which contain from about 5 to about 8 or about 5 to about 9 lower alkoxy groups per mole. Preferably, the lower alkoxy is ethoxy but in some instances, it may be desirably mixed with propoxy, the latter, if present, usually being minor (no more than 50%) portion. Exemplary of such compounds are those wherein the alkanol has about 12 to about 15 carbon atoms and which contain 7 ethylene oxide groups per mole.

Useful nonionics are represented by the low foaming Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A (a $C_{13}$–$C_{15}$ fatty alcohol condensed with 6 moles ethylene oxide and 3 moles propylene oxide), Product B (a $C_{13}$–$C_{15}$ fatty alcohol condensed with 7 mole propylene oxide and 4 mole ethylene oxide), and Product C (a $C_{13}$–$C_{15}$ fatty alcohol condensed with 5 moles propylene oxide and 10 moles ethylene oxide). A particularly good surfactant is Plurafac 132 which is a capped nonionic surfactant. Another group of low foam liquid nonionics are available from Shell Chemical Company, Inc. under the Dobanol trademark: Dobanol 91–5 is an ethoxylated $C_9$–$C_{11}$ fatty alcohol with an average of 5 moles ethylene oxide and Dobanol 25–7 is an $C_{12}$–$C_{15}$ fatty alcohol with an average of 7 moles ethylene oxide. Another liquid nonionic surfactant that can be used is sold under the tradename Lutensol SC 9713.

Synperonic nonionic surfactants such as Synperonic LF D25 are especially preferred nonionic surfactants that can be used in the nonaqueous liquid automatic dishwasher detergent compositions of the instant invention. Other useful nonionic surfactants are Synperonic RA 30, Synperonic RA 40 and Synperonic RA 340. The Synperonic surfactants are especially preferred because they are biodegradable and low foaming.

Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent.

Other useful surfactants are Neodol 25–7 and Neodol 23–6.5, which products are made by Shell Chemical Company, Inc. The former is a condensation product of a mixture of higher fatty alcohols averaging 12 to 13 carbon atoms and the number of ethylene oxide groups present averages 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product having about 11 to about 15 carbon atoms linear secondary alkanol with seven moles of ethylene oxide and the latter is a similar product but with nine moles of ethylene oxide being reacted. Another useful surfactant is Tergitol MDS-42 a mixed ethoxylation product of 13–15 cations alcohols with 10 moles of EO and 5 moles of PO.

Also useful in the present compositions as a component of the nonionic detergent are higher molecular weight nonionics, such as Neodol 45-11, which are similar ethylene oxide condensation products of higher fatty alcohols, with the higher 5 fatty alcohol being of about 14 to about 15 carbon atoms and the number of ethylene oxide groups per mole being 11. Such products are also made by Shell Chemical Company.

in the preferred poly-lower alkoxylated higher alkanols, to obtain the best balance of hydrophilic and lipophilic moleties the number of lower alkoxies will usually be from about 40% to 100% of the number of carbon atoms in the higher alcohol, preferably about 40% to about 60% thereof and the nonionic detergent will preferably contain at least about 50% of such preferred polyolower alkoxy higher alkanol.

The alkyl polysaccharides surfactants, which are used alone in conjunction with the aforementioned surfactant and have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moleties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4-positions rather than at the I-position, (thus giving e.g. a glucosyl or galactosyl as opposed to a glucoside or galactoside). However, attachment through the 1-position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moleties.

Suitable alkyl polysaccharides are decyl, dodecyl, tetradecyl, pentadecyl, hexadecyl, and octadecyl, di-, tri-, tetra-, penta- and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$R_2O(C_nH_{2n}O)r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferable 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) an be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is APG 625 glycoside manufactured by the Henkel Corporation of Ambler, Pa. APG 25 is a nonionic alkyl polyglycoside characterized by the formula:

$$C_nH_{2n+1}O(C_6H_{10}O_5)_xH$$

wherein n=10 (2%); n=12 (65%); n=14 (21–28%); n=16 (4–8%) and n=18 (0.5%) and x (degree of polymerization)= 1.6 APG 625 has: a pH of 6–8 (10% of APG 625 in distilled water); a specific gravity at 25° C. of I.I g/ml; a density at 25° C. of 9.1 lbs/gallon; a calculated HLB of 12.1 and a Brookfield viscosity at 35° C., 21 spindle, 5–10 RPM of 3,000 to 7,000 cps.

Mixtures of two or more of the liquid nonionic surfactants can be used and in some cases advantages can be obtained by the use of such mixtures.

The gelled compositions of the instant invention contain fine particles of an organic and/or an inorganic detergent builder salt. A preferred solid builder salt is an alkali metal polyphosphate such as sodium tripolyphosphate ("TPP"). In place of all or part of the alkali metal polyphosphate one or more other detergent builder salts can be used. Suitable other builder salts are alkali metal carbonates, citrates, tartarates, borates, phosphates, bicarbonates, lower polycarboxylic acid salts, and polyacrylates, polymaleic anhydrides and copolymers of polyacrylates and polymaleic anhydrides and polyacetal carboxylates. The total concentration of the alkali metal detergent builder salts in the composition is about 2 to about 70 weight %, more preferably about 2 to about 60 wt. %.

Specific examples of such builders are sodium carbonate, potassium carbonate, sodium citrate, potassium citrate, sodium tetraborate, sodium pyrophosphate, sodium tripolyphosphate, potassium tripolyphosphate, potassium pyrophosphate, sodium bicarbonate, sodium hexametaphosphate, sodium sesquicarbonate, sodium mono and diorthophosphate, and potassium bicarbonate. The builder salts can be used alone or in an admixture with other builders. Typical builders also include those disclosed in U.S. Pat. Nos. 4,316,812, 4,264,466 and 3,630,929 and those disclosed in U.S. Pat. Nos. 4,144,226, 4,135,092 and 4,146,495.

A preferred builder salt is sodium tripolyphosphate (TPP). The TPP is a blend of anhydrous TPP and a small amount of TPP hexahydrate such that the chemically bound water content corresponds to one $H_2O$ per pentasodium tripolyphosphate molecule. Such TPP may be produced by treating anhydrous TPP with a limited amount of water. The presence of the hexahydrate slows down the rapid rate of solution of the TPP in the wash bath and inhibits caking. One suitable TPP is sold under the name Thermphos NW. The particles size of the Thermphos NW TPP, as supplied, is usually averages 200 microns with the largest particles being 400 microns. Potassium tripolyphosphate and potassium pyrosphosphate can also be used. Nonphosphate builders such as alkali metal carbonates, alkali metal tartartee, alkali metal gluconates and alkali metal carbonates, alkali metal citrates and mixtures thereof can be used with the phosphate builders.

The alkali metal silicates are useful builder salts which also function to make the composition anti-corrosive so that damage to eating utensils and to automatic dishwashing machine parts is minimized. Sodium silicates of $Na_2O/SiO_2$ ratios of from 1:1 to 1:2.4 especially 1:2 to 1:3 are preferred. Potassium silicates of the same ratios can also be used. The preferred alkali metal silicates are sodium disilicate and sodium metasilicate.

Another class of builders useful herein are the water insoluble aluminosilicates, both of the crystalline and amorphous type. Various crystalline zeolites (i.e. aluminosilicates) are described in British Patent No. 1,504,168, U.S. Pat. No. 4,409,136 and Canadian Patent Nos. 1,072,835 and 1,087,477. An example of amorphous zeolites useful herein can be found in Belgium Patent No. 835,351. The zeolites generally have the formula $$(M_2O_x(Al_2O_3)_y(SiO_2)_z wH_2O$$

wherein x is 1, y is from 0.8 to 1.2 and preferably 1, z is from 1 o5 to 3.5 or higher and preferably 2 to 3 and w is from 0 to 9, preferably 2.5 to 6 and M is preferably sodium. A typical zeolite is type A or similar structure, with type 4A particularly preferred. The preferred aluminosilicates have calcium ion exchange capacities of 200 milliequivalents per gram or greater, e.g. 400 meq/g.

In conjunction with the builder salt are optionally used at a concentration of about 0 to 25 weight %, more preferably 1 to 20 wt. %, a low molecular weight non crosslinked polyacrylate which has a molecular weight of about 1,000 to about 100,000 more preferably about 2,000 to about 80,000. A preferred low molecular weight polyacrylate is Sokalan™ CP45 manufactured by BASF and having a molecular weight of about 70,000. Another preferred low molecular weight polyacrylate is Acrysol™ 45ND manufactured by Rohm and Haas and having a molecular weight of about 4,500. A suitable suspending and anti-redepositing agent consists of a copolymer of a polyacid and an acid anhydride. Such a material should have a water absorption at 38° C. and 78 percent relative humidity of less than about 40 percent and preferably less than about 30 percent. The builder is commercially available under the tradename of Sokalan CP 45. This is a partially neutralized copolymer of acrylic acid and maleic acid sodium salt. This suspending and anti-deposition agent also serves to inhibit encrustation, i.e. inhibits the formulation and precipitation of dicalcium phosphate. This suspending agent has a low hygroscopicity as a result of a decreased hydroxyl group content. An objective is to use suspending and anti-redeposition agents that have a low hygroscopicity. Copolymerized polyacids have this property, and particularly when partially neutralized. Acusol™ 640 ND provided by Rohm & Haas is another useful suspending agent. Other builder salts which can be mixed with the sodium carbonate are gluconates and nitriloacetic acid salts.

The thickening or gelling agents used in the instant compositions are a hydroxypropylcellulosic polymer such as Klucel HF polymer sold by Aqualon having a molecular weight of about 80,000 to about 1,200,000 in combination with a glycol such as propylene glycol at a concentration of about 5 to 25 wt. percent, more preferably about 10 wt percent to about 20 wt. percent. The hydroxypropylcellulosic polymer is used at a concentration of about 0.1 to about 10 wt. percent, more preferably about 0.1 to about 5 wt. percent.

Essentially, any compatible anti-foaming agent can be optionally used. Preferred anti-foaming agents are silicone anti-foaming agents. These are alkylated polysiloxanes and include polydimethyi siloxanes, polydiethyl siloxanes, polydibutyl siloxanes, phenyl methyl siloxanes, dimethyl silanated silica, trimethysilanated silica and triethylsilanated silica. Suitable anti-foam agents are Silicone L7604 and DB100. Other suitable anti-foaming agents are Silicone DB 700 used at 0 to 1.5 wt. %, more preferably 0.2 to 1.0 weight %, sodium stearate used at a concentration and of 0.5 to 1.0 weight %. Another class of suitable foam depressants used at concentration levels of 0 to about 1.5 weight %, more preferably about 0.2 to about 1.0 weight %. are the alkyl phosphoric acid esters of the formula

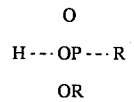

available from BASF-Wyandotte and the alkyl phosphate esters of the formula

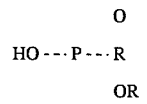

available from Hooker (SAP) and Knapsack (LPKn-158) in which one or both R groups in each type of ester may be represented independently by a $C_{12-20}$ alkyl or ethoxylated alkyl group.

The perfumes that can be used include lemon perfume and other natural scents. Essentially, any opacifier pigment that is compatible with the remaining components of the detergent formulation can be used. A useful and preferred opacifier is titanium dioxide.

The organic liquid carrier materials that can be used for the liquid automatic dishwashing detergent compositions are contained in the composition at a concentration level of at least about 35 wt. % to about 65 wt. %, more preferably at least about 40 wt. % to about 65 wt. %, are those that have a low hydroscopicity. These include the higher glycols, polyglycols, polyoxides and glycol ethers. Suitable substances are propylene glycol, polyethylene glycol, polypropylene glycol, diethylene glycol monoethyl ether, diethylene glycol monopropyl ether, diethylene glycol monobutyl ether, tripropylene glycol methyl ether, propylene glycol methyl ether (PM), dipropylene glycol methyl ether (DPM), propylene glycol methyl acetate (PMA), dipropylene glycol methyl ether acetate (DPMA), ethylene glycol n-butyl ether and ethylene glycol n-propyl ether. A preferred nonaqueous carrier of the instant invention is polyethylene glycol 200 or polyethylene glycol 300.

Other useful solvents are ethylene oxide/propylene oxide, propylene oxide liquid random copolymer such as Synalox solvent series from Dow Chemical (Synalox 50-50B). Other suitable solvents are propylene glycol ethers such as PnB, DPnB and TPnB (propylene glycol mono n-butyl ether, dipropylene glycol and tripropylene glycol mono n-butyl ethers sold by Dow Chemical under the tradename Dowanol. Also tripropylene glycol mono methyl ether "TPM Dowanol" from Dow Chemical is suitable. Another useful series of solvents are supplied by CCA blochem b.u. of Holland such as Purasolv $^{R}$ML, Purasolv $^{R}$EL(S), Purasolv $^{R}$EL, Purasolv $^{R}$IPL and Purasolv $^{R}$BL.

Mixtures of PEG solvent with Synalox or PnB, DPnB, TPnB and TPM solvents are also useful. Preferred mixtures are PEG 300/Synalox 50-50B and PEG 300/TPnB in weight ratios of 95:5 to 50:50. EP/PO capped nonionic surfactants can be used as a liquid solvent carrier and an example of such a nonionic surfactant is Plurafac LF 132 sold by BASF.

A key aspect is to keep the free water (non-chemically bounded water) in the detergent composition at a minimum. Absorbed and adsorbed water are two types of free water, and comprise the usual free water found in a detergent composition. Free water will have the affect of deactivating the enzymes.

The detergent composition of the present invention can possibly include a peroxygen bleaching agent at a concentration of about 0 to about 15 wt. %. The oxygen bleaching agents that can be used are alkali metal perborate, perphthalic acid, percarbonate and perphosphates, and potassium monopersulfate. A preferred compound is sodium perborate monohydrate. The peroxygen bleaching compound is preferably used in admixture with an activator thereof. Suitable activators are those disclosed in U.S. Pat. No. 4,264,466 or in column 1 of U.S. Pat. No. 4,430,244. Polyacylated compounds are preferred activators. Suitable preferred activators are tetraacetyl ethylene diamine ("TAED"), pentaacetyl glucose, and ethyledine benzoate acetate.

The activator which is present at a concentration of 0 to about 5.0 wt. %, more preferably about 0.5 to about 5.0 wt. % usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Suitable sequestering agents include the sodium salts of nitrilotriacetic acid (NTA), ethylene diamine tetraacetic acid (EDTA), diethylene triamine pentaacetic acid (DETPA), diethylene triamine pentamethylene phosphoric acid (DTPMP) sold under the tradename DEQUEST 2066 and ethylene diamine tetramethylene phosphoric acid (EDITEMPA). The sequestering agents can be used alone or in an admixture.

The detergent formulation also contains a mixture of at lease one protease enzyme and an amylase enzyme that serve to attack and remove organic residues on glasses, plates, pots, pans and eating utensils. Proteolytic enzymes remove protein residues and amylolytic enzymes remove starches. Proteolytic enzymes include the protease enzymes subtilism, bromelin, papain, trypsin and pepsin. Amylolytic enzymes include alphaamylase enzymes. The preferred amylase enzyme is available under the name Maxamyl and is available from Gist-Brocades of the Netherlands in the form of a nonaqueous slurry (18 wt. % of enzymes) having an activity of 40,000 TAU/g. One preferred protease enzyme is available under the name Maxatase, and is derived from a novel Bacillus strain designated "PB92" wherein a culture of the Bacillus is deposited with the Laboratory for Microbiology of the Technical University of Delft and has the number OR-60. Maxatase protease enzyme is a low alkaline B. licheniformis protease 600,000 DU/g which is supplied in a nonaqueous slurry (18 weight percent) by International BioSynthetics (Gist-Brocades) One of the preferred protease enzyme is available under the name Protein Engineered Maxacal or Maxapem 15 or Maxapem 42 (PEM 42) and is derived from Bacillus alcalophylus which is a high alkaline mutant proteolytic enzyme and is available from Gist-Brocades, of the Netherlands. Maxapem 42 is supplied in a nonaqueous slurry (18 wt. % of enzyme/activity of 900,000 ADU/g). Preferred enzyme activities per wash are Maxapem 42 200–1000 KADU per wash and Maxamyl 1,000–10,000 TAU per wash. Maxapem 15 is supplied in a nonaqueous slurry (5.55% wt. of enzyme with activity 400,000 ADU/g and preferred enzyme activity of Maxapem 15 is 200–1,000 KADU per wash. Maxatase and Maxapem can be used together.

Maxapem 42 protease enzyme is supplied in a nonaqueous slurry (18 weight percent) by International BioSynthetics (Gist-Brocades). Maxamyl amylase enzyme is a thermostable B. licheniformis alpha-amylase (40,500 TAU/g) which is supplied in a nonaqueous slurry (18 weight percent) by International BioSynthetics (Gist Brocades). At a concentration level of 3.5% of Protein Engineered Maxacal 42 and 1.0% of Maxamyl in the instant automatic dishwashing compositions, a 25 gram dose of automatic dishwashing composition per wash delivers 10,000 TAU of Maxamyl amylase and 787,500 ADU of Protein Engineered Maxacal 42 protease. Maxapem 42/Maxatase protease 250–1,000 KADU/KDU and Maxamyl 4,000–10,000 TAU per wash. At a concentration of 1.75%, Maxatase, 1.75% Protein Engineered Maxacal 42 (Maxapem 42) and 1.0% Maxamyl in the instant automatic dishwashing compositions, a 25 gram dose of automatic dishwashing composition per wash delivered 10,000 TAU of Maxamyl amylase and 656,250 DU/ADU of protease enzymes.

The weight ratio of the one or two Protease enzymes (Maxatase and Maxapem 42) taken together to the amylolytic enzyme in the nonaqueous liquid automatic dishwasher detergent compositions is about 6:1 to about 1.1:1 more preferably about 4.5:1 to about 1.2:1. The weight ratio of Maxatase to Protein Engineered Maxacal enzyme 42 is about 1.8:1 to about 1:1.

The weight ratio of the Protease enzyme to the amylolytic enzyme in the nonaqueous liquid automatic dishwasher detergent compositions is 6:1 to 1.1:1 more preferably 4.5:1 to 1.2:1.

Another useful amylase enzyme sold by Novo is Termamyl 300L DX having an activity of 300 KNU/g. It is an alpha amylase prepared by submerged fermentation of a selected strain of Bacillus liceniformis.

Another useful protease enzyme is Savinase 16.0L Type EX sold by Novo. It has an actively of 16. KNPU/g and is prepared by submerged fermentation of an alcalophilic strain of Bacillus. Another useful protease enzyme is Durazym 16.0 L Type EX which is sold by Novo and has an activity of 16DPU/g. It is a protein-engineered variant of Savinase. Maxacal enzyme sold by Gist Brocoades is another useful protease enzyme.

The detergent composition can have a fairly wide ranging composition. The surfactant can comprise 0 to about 15 percent by weight of the composition, more preferably about 1 to about 15 percent by weight, and most preferably about 4 to about 12 percent by weight. The soil suspending agent which is preferably a copolymerized non crosslinked polyacrylic acid will be present in an amount of 0 to about 20 percent by weight, more preferably about 1 to about 20 percent by weight and most preferably about 2 to about 10 percent by weight. The anti-foaming agent will be present in an amount of 0 to about 2.5 percent by weight, more preferably about 0.1 to about 2.0 percent by weight and most preferably about 0.2 to about 1.5 percent by weight. The builder, which is preferably sodium tripolyphosphate, is present in an amount of about 2 to about 70 percent by weight, more preferably about 5 to about 60 percent by weight and most preferably about 10 to about 40 percent by weight.

The alkali metal silicate, of which sodium silicate is preferred, will be present in an amount of 0 to about 25 percent by weight, more preferably about 5 to about 20 percent by weight and most preferably 5 to 15 percent by weight. The opacifier pigment will be present in an amount of 0.0 to about 1.0 percent by weight, more preferably about 0.1 to about 1.0 percent by weight and most preferably 0.5 percent 0 by weight.

The enzymes will be present in slurry form (18% enzyme in polyethylene glycol 400) in an amount of about 0.8 to about 16.0 percent by weight, more preferably about 0.9 to about 14.0 percent by weight, and most preferably about 1.0 to about 12.0 percent by weight. The Protein Engineered Maxacal 42 protease in the automatic 5 dishwashing composition enzyme will comprise about 0.5 to about 8.0 percent by weight, more preferably about 0.7 to about 6.0 weight percent and most preferably about 0.8 to about 5.0 percent by weight. The amylase enzyme will comprise about 0.3 to about 6.0 percent by weight, more preferably about 0.4 to about 3.0 weight percent and most preferably 0.5 to 2.0 weight percent. Other components such as color and perfumes will be comprised of about 0.1 to about 1.0 percent by weight of the detergent composition. The remainder of the detergent composition will be comprised of the nonaqueous carrier. This will range from 40 to 65 weight percent, more preferably 45 to 60 weight percent.

A preferred gelled composition of the instant invention has less than about 3 wt. percent of free water and a pH of less than about 11.0 and a Brookfield viscosity at RT, #5 spindle, 20rpms of about 5,000 to about 20,000 cps. comprises approximately by weight:

(a) 1 to 12 percent of a liquid nonionic surfactant;

(b) 0 to 70 percent of at least one alkali metal phosphate detergent builder salt;

(c) 0.1 to 2.0 percent of an-antifoaming agent;

(d) 0 to 40 percent of at least one alkali metal phosphate free detergent builder salt;

(e) 1.5 to 12.0 percent of at least one protease enzyme;

(f) 0.1 to 6.0 percent of an amylase enzyme;

(g) 1 to 20 percent of a low molecular weight non crosslinked polyacrylate polymer;

(h) 0 to 15.0 percent of an alkali metal perborate;

(i) 0.5 to 5.0 percent of an alkali metal perborate activator;

(i) 0 to 1.5% of a colorant;

(k) 35 to 65% of a nonaqueous liquid organic carrier material; and (I) 5 to 35% of a stabilizing system which consists of a blend of 0. 1 to 10 percent of a hydroxypropylcellulosic polymer and a polymer gelling or swelling agent such as propylene glycol at a concentration of 5 to 25 weight percent; wherein the composition does not contain any caesin, collagen or a lipolytic enzyme.

The composition of the instant invention have a G' value of about 5 to about 100 Pa, more preferably about 10 to about 75 Pa and most preferably about 15 to about 50 Pa over a 10 to 50 percent strain range; a G" value of about 5 to about 100 Pa, more preferably about 10 to about 75 Pa, and most preferably about 15 Pa to about 50 Pa over a 10 to 50 percent strain range. The G' and G" values are measured on a Cari-Med CSL 100 Rheometer in a dynamic made (torque sweep). The torque sweep experiment is measured at a constant frequency of oscillation, the tested sample is submitted to an increasing stress (increasing amplitude of oscillation and thereby increasing strain). G' and G" are measured versus strain.

The detergent formulation is produced by first combining with mixing the propylene glycol and the hydroxypropyl cellulosic polymer at 70 degrees C. To this gelled mixture is adding with mixing in the following order the organic liquid carrier material, the surfactant, the disilicate, the alkali metal detergent builder salt, the low molecular weight non crosslinked polymer and finally the enzymes and mixing is continued to a homogenous gelled product is obtained. Then the opacifiers, brighteners, and perfumes are added. After a thorough mixing, the detergent composition is packaged.

The concentrated nonaqueous liquid nonionic automatic dishwashing detergent compositions of the present invention disperses readily in the water in the dishwashing machine. The presently used home dishwashing machines have a measured capacity for 80 cc or 90 grams of detergent. In normal use, for example, for a full load of dirty dishes 60 grams of powdered detergent are normally used.

In accordance with the present invention only 20 cc to 35 cc or 40 grams or less of the concentrated liquid nonionic detergent composition is needed, and more preferably 20 cc or 25 grams of concentrated liquid is used per dispenser cup. The normal operation of an automatic dishwashing machine can involve the following steps or cycles: washing, rinse cycles with hot water. The entire wash and rinse cycles require 120 minutes. The temperature of the wash water is 100° F. to 140° F. and the temperature of the rinse water is 100° F. to 140° F. The wash and rinse cycles use 8 to 12 liters of water for the wash cycle and 8 to 12 liters of water of the rinse cycle.

The highly concentrated nonaqueous gelled automatic dishwashing detergent compositions exhibit excellent cleaning properties of proteinaceous soils such as egg and starchy carbohydrates such as oatmeal and minimizes the formation of spots and films on the dishware and glasses. In an embodiment of the invention the stability of the builder salts in the composition during storage and the dispersibility of the composition in water is improved by grinding and reducing the particle size of the solid builders to less than 100 microns, preferably less than 40 microns and more preferably to less than 10 microns. The solid builders are generally supplied in particle sizes of 100,200 or 400 microns, The liquid nonaqueous carrier phase can be possibly mixed with the solid builders prior to carrying out the grinding operation..

In the grinding operation it is preferred that the proportion of solid ingredients be high enough (e.g. at least 40%, such as 50%) that the solid particles are in contact with each other and are not substantially shielded from one another by the liquid nonaqueous carrier. After the grinding step any remaining liquid nonaqueous carrier can be added to the ground formulation. Mills which employ grinding balls (ball mills) or similar mobile grinding elements give very good results. For larger scale work a continuously operating mill in which there are 1 mm. or 1.5 mm diameter grinding balls working in a very small gap between a stator and a rotor operating at a relatively high speed e.g. a CoBall mill or a Netzsch ball mill may be employed; when using such a mill, it is desirable to pass the blend of liquid nonaqueous carrier and solids first through a mill which does not effect such fine grinding (e.g. to 40 microns) prior to the step of grinding to an average particle diameter below 10 microns in the continuous ball mill.

It is also contemplated within the scope of this invention to form compositions without grinding, wherein he particle size has a distribution of 60–120 microns. In a preferred embodiment the detergent builder particles have a particle size distribution such that no more than 10% by weight of said particles have a particle size of more than 10 microns.

DESCRIPTION OF THE PREFERRED EMBODIMENTS

EXAMPLE 1

The concentrated nonaqueous liquid dishwasher detergent compositions were formulated from the following ingredients in the amounts specified.

| | Comparison | | |
|---|---|---|---|
| Ingredients | Maxapem 42 Comp(a) | Maxatase Comp(b) | Maxacal Comp(c) |
| Polyethylene Glycol 300 | Balance | Balance | Balance |
| Synperonic LFD 25 Surfactant | 8.00 | 8.00 | 8.00 |
| Sodium Silicate ($Na_2O:SiO_2$/1:2) | 9.00 | 8.00 | 9.00 |
| Sodium Tripolyphosphate Anhy. | 30.00 | 30.00 | 30.00 |
| Sokalan CP 45 Polymer | 5.00 | 5.00 | 5.00 |
| Maxamyl Amylase Enzyme Slurry (activity: 42,800 TAU/g) | 1.00 | 1.00 | 1.00 |
| Protein Engineered Maxacal 42 (Maxapem 42) Slurry (activity: 900,228 ADU/g) | 3.50 | — | — |
| Maxacal Protease Enzyme Slurry (activity: 890,509 ADU/g) | — | — | 3.50 |
| Maxatase Protease Enzyme Slurry (activity: 604,000 DU/g) | — | 3.50 | — |
| pH (1% solution) | 9.10 | 8.80 | 9.10 |

| Wash | Wash Water (ppm) | Invention Maxapem 42 Comp(a) | | Invention Maxatase Comp(b) | | Comparison Maxacal Comp(c) | |
|---|---|---|---|---|---|---|---|
| Temp. °F. | Soil Removal, % | Egg | Oatmeal | Egg | Oatmeal | Egg | Oatmeal |
| 100 | Soft (10) | 65 | 100 | 20 | 100 | 51 | 100 |
| | Tap (110) | 70 | 100 | 13 | 100 | 9 | 100 |
| | Hard (300) | 2 | 100 | 2 | 100 | 3 | 100 |
| | Average | 46 | 100 | 12 | 100 | 21 | 100 |
| 120 | Soft (10) | 80 | 100 | 70 | 100 | 83 | 100 |
| | Tap (100) | 98 | 100 | 80 | 100 | 54 | 100 |
| | Hard (300) | 29 | 100 | 36 | 100 | 22 | 100 |
| | Average | 69 | 100 | 62 | 100 | 53 | 100 |
| 130 | Soft (10) | 88 | 100 | 30 | 100 | 83 | 100 |
| | Tap (110) | 92 | 100 | 73 | 100 | 64 | 100 |
| | Hard (300) | 64 | 100 | 43 | 100 | 17 | 100 |
| | Average | 81 | 100 | 49 | 100 | 55 | 100 |
| 135 | Soft (10) | 80 | 100 | 2 | 100 | 88 | 100 |
| | Tap(110) | 84 | 100 | 2 | 100 | 76 | 100 |
| | Hard (300) | 39 | 100 | 22 | 100 | 31 | 100 |
| | Average | 68 | 100 | 9 | 100 | 65 | 100 |
| 140 | Soft (10) | 12 | 100 | 2 | 100 | 75 | 100 |
| | Tap(110) | 16 | 100 | 2 | 100 | 40 | 100 |
| | Hard (300) | 40 | 100 | 26 | 100 | 26 | 100 |
| | Average | 22 | 100 | 10 | 100 | 47 | 100 |
| Overall Average | | 57 | 100 | 28 | 100 | 48 | 100 |

EXAMPLE 2

Concentrated nonaqueous liquid dishwasher detergent compositions were formulated from the following ingredients in the amounts specified.

| Maxacal Ingredients | Comparison | | | |
|---|---|---|---|---|
| | Maxatase and Maxapem 42 Comp(a) | Maxapem 42 Comp(b) | Maxatase Comp(c) | Maxacal Comp(d) |
| Polyethylene Glycol 300 | Balance | Balance | Balance | Balance |
| Synperonic LFD 25 Surfactant | 8.00 | 8.00 | 8.00 | 8.00 |
| Sodium Silicate ($Na_2O:SiO_2$/1:2) | 9.00 | 8.00 | 9.00 | 9.00 |
| Sodium Tripolyphosphate Anhy. | 30.00 | 30.00 | 30.00 | 30.00 |
| Sokalan CP 45 Polymer | 5.00 | 5.00 | 5.00 | 5.00 |
| Maxamyl Amylase Enzyme Slurry (activity: 42,800 TAU/g) | 1.00 | 1.00 | 1.00 | 1.00 |
| Maxacal Protease Enzyme Slurry | — | — | — | 3.5 |
| Protein Engineered Maxacal 42 (Maxapem 42) Slurry (activity: 900,228 ADU/g) | 1.75 | 3.50 | — | — |
| Maxatase Protease Enzyme Slurry (activity: 604,000 DU/g) | 1.75 | — | 3.50 | — |
| pH (1% solution) | 9.10 | 8.80 | 9.10 | 9.10 |

| Wast | Wast Water (ppm) | Invention Maxatase and Maxapem 42 Comp(a) | | Invention Maxapen 42 Maxatase Comp(b) | | Comparison Maxatese Comp(c) | |
|---|---|---|---|---|---|---|---|
| Temp. °F. | Soil Removal, % | Egg | Oatmeal | Egg | Oatmeal | Egg | Oatmeal |
| 100 | Soft (10) | 65 | 100 | 65 | 100 | 51 | 100 |
| | Tap (110) | 70 | 100 | 70 | 100 | 9 | 100 |
| | Hard (300) | 3 | 100 | 2 | 100 | 3 | 100 |
| | Average | 46 | 100 | 46 | 100 | 21 | 100 |
| 120 | Soft (10) | 83 | 100 | 80 | 100 | 83 | 100 |
| | Tap (100) | 98 | 100 | 98 | 100 | 54 | 100 |
| | Hard (300) | 29 | 100 | 29 | 100 | 22 | 100 |
| | Average | 70 | 100 | 69 | 100 | 53 | 100 |
| 130 | Soft (10) | 88 | 100 | 88 | 100 | 83 | 100 |
| | Tap (110) | 92 | 100 | 92 | 100 | 64 | 100 |
| | Hard (300) | 64 | 100 | 64 | 100 | 17 | 100 |
| | Average | 81 | 100 | 81 | 100 | 55 | 100 |
| 135 | Soft (10) | 88 | 100 | 80 | 100 | 88 | 100 |
| | Tap (110) | 84 | 100 | 84 | 100 | 76 | 100 |
| | Hard (300) | 39 | 100 | 39 | 100 | 31 | 100 |
| | Average | 70 | 100 | 68 | 100 | 65 | 100 |
| 140 | Soft (10) | 75 | 100 | 12 | 100 | 75 | 100 |
| | Tap (110) | 40 | 100 | 16 | 100 | 40 | 100 |
| | Hard (300) | 40 | 100 | 40 | 100 | 26 | 100 |
| | Average | 52 | 100 | 22 | 100 | 47 | 100 |
| Overall Average | | 64 | 100 | 57 | 100 | 48 | 100 |

EXAMPLE 3

Concentrated nonaqueous liquid dishwasher detergent compositions are formulated from the following ingredients in the amounts specified.

| Ingredients | Comparison | | |
|---|---|---|---|
| | Maxatase Comp(a) | Maxatase Comp(b) | Maxacal Comp(c) |
| Polyethylene Glycol 300 | Balance | Balance | Balance |
| Synperionic LFD 25 | 8.00 | 8.00 | 8.00 |

-continued

| | | | |
|---|---|---|---|
| Surfactant | | | |
| Sodium Silicate ($Na_2O:SiO_2$/1:2) | 9.00 | 8.00 | 9.00 |
| Sodium Tripolyphosphate Anhydrous | 30.00 | 30.00 | 30.00 |
| Sokalan CP 45 Polymer | 5.00 | 5.00 | 5.00 |
| Maxamyl Amylase Enzyme Slurry (activity: 42,800 TAU/g) | 1.00 | 1.00 | 1.00 |
| Maxacal Protease Enzyme Slurry (activity: 890,509 ADU/g) | — | — | 3.50 |
| Maxatase Protease Enzyme Slurry (activity: 604,000 DU/g) | 3.50 | 3.50 | — |
| pH (1% solution) | 9.10 | 8.80 | 9.10 |

| Wash | Wash Water (ppm) | Invention Maxatase Comp(a) | | Invention Maxatase Comp(b) | | Comparison Maxacal Comp(c) | |
|---|---|---|---|---|---|---|---|
| Temp. °F. | Soil Removal, % | Egg | Oatmeal | Egg | Oatmeal | Egg | Oatmeal |
| 100 | Soft (10) | 51 | 100 | 42 | 100 | 20 | 100 |
| | Tap (110) | 9 | 100 | 10 | 100 | 13 | 100 |
| | Hard (300) | 3 | 100 | 10 | 100 | 2 | 100 |
| | Average | 21 | 100 | 21 | 100 | 12 | 100 |
| 120 | Soft (10) | 83 | 100 | 80 | 100 | 70 | 100 |
| | Tap (100) | 54 | 100 | 82 | 100 | 80 | 100 |
| | Hard (300) | 22 | 100 | 23 | 100 | 36 | 100 |
| | Average | 53 | 100 | 62 | 100 | 62 | 100 |
| 130 | Soft (10) | 83 | 100 | 83 | 100 | 30 | 100 |
| | Tap (110) | 64 | 100 | 88 | 100 | 73 | 100 |
| | Hard (300) | 17 | 100 | 14 | 100 | 43 | 100 |
| | Average | 55 | 100 | 61 | 100 | 49 | 100 |
| 135 | Soft (10) | 88 | 100 | 76 | 100 | 2 | 100 |
| | Tap (110) | 76 | 100 | 77 | 100 | 2 | 100 |
| | Hard (300) | 31 | 100 | 30 | 100 | 22 | 100 |
| | Average | 65 | 100 | 61 | 100 | 9 | 100 |
| 140 | Soft (10) | 75 | 100 | 48 | 100 | 2 | 100 |
| | Tap (110) | 40 | 100 | 56 | 100 | 2 | 100 |
| | Hard (300) | 26 | 100 | 49 | 100 | 26 | 100 |
| | Average | 47 | 100 | 51 | 100 | 10 | 100 |
| Overall Average | | 48 | 100 | 51 | 100 | 28 | 100 |

EXAMPLE 4

Concentrated nonaqueous liquid dishwasher detergent compositions were formulated from the following ingredients in the amounts specified.

| | A | B |
|---|---|---|
| PEG 300 | Balance | Balance |
| Synperonic LF/D25 | 6.0 | 6.0 |
| SAG 1000 silicone antifoam | 0.2 | 0.2 |
| Sodium disilicate (hydrated) | 5.0 | 5.0 |
| Na Tripolyphosphate TPP M1 anhydrous | 35.0 | 35.0 |
| Sokalan CP5 | 5.0 | 5.0 |
| Maxacal slurry (a) | 3.2 | 3.5 |
| Maxamyl slurry (b) | 0.6 | 0.8 |
| Cabosil EH-5 silica | 1.5 | 1.35 |
| Phase separation in height % | | |
| RT | | |
| (6 weeks) | 4.5% | 4.0% |
| (12 weeks) | 4.5% | — |
| 4° C. | | |
| (6 weeks) | — | 3.0% |
| (12 weeks) | 2.5% | — |

-continued

| | A | B |
|---|---|---|
| 35° C. | | |
| (6 weeks) | — | 5% |
| (12 weeks) | 5.4% | — |

(a) Activity: 1,000,000 ADU/g
(b) Activity: 40,000 TAU/g

| Dosage | A 25 g | A 28 g (20 ml) |
|---|---|---|
| Cleaning performance ratings 0–10 | | |
| St. steel saucepan: burnt milk | 2.75 | 3.5 |
| Tea | 9.5 | 9.0 |
| Plates: eggs microwave | 4.67 | 4.92 |
| Plates: porridge | 9.96 | 10.0 |
| St. steel dish: rice | 7.75 | 9.5 |
| Pyrex dish: white sauce | 7.25 | 7.75 |
| Cutlery: rice | 8.75 | 9.25 |
| Cutlery: rice & cheese | 9.0 | 9.5 |
| Cutlery: porridge | 9.75 | 9.75 |
| Cleaning performance average score | 7.71 | 8.13 |

-continued

| Dosage | A 25 g | A 28 g (20 ml) |
|---|---|---|
| Glasses rating 0–10 | | |
| Daylight: glasses/burnt milk | 2.8 | 3.5 |
| Viewing box: glasses (global) | 4.9 | 5.0 |
| Viewing box: filming | 7.0 | 7.4 |
| Viewing box: spotting | 4.7 | 4.8 |
| Glasses average score | 4.9 | 5.2 |

Laboratory Cleaning Performance

Figure 2:
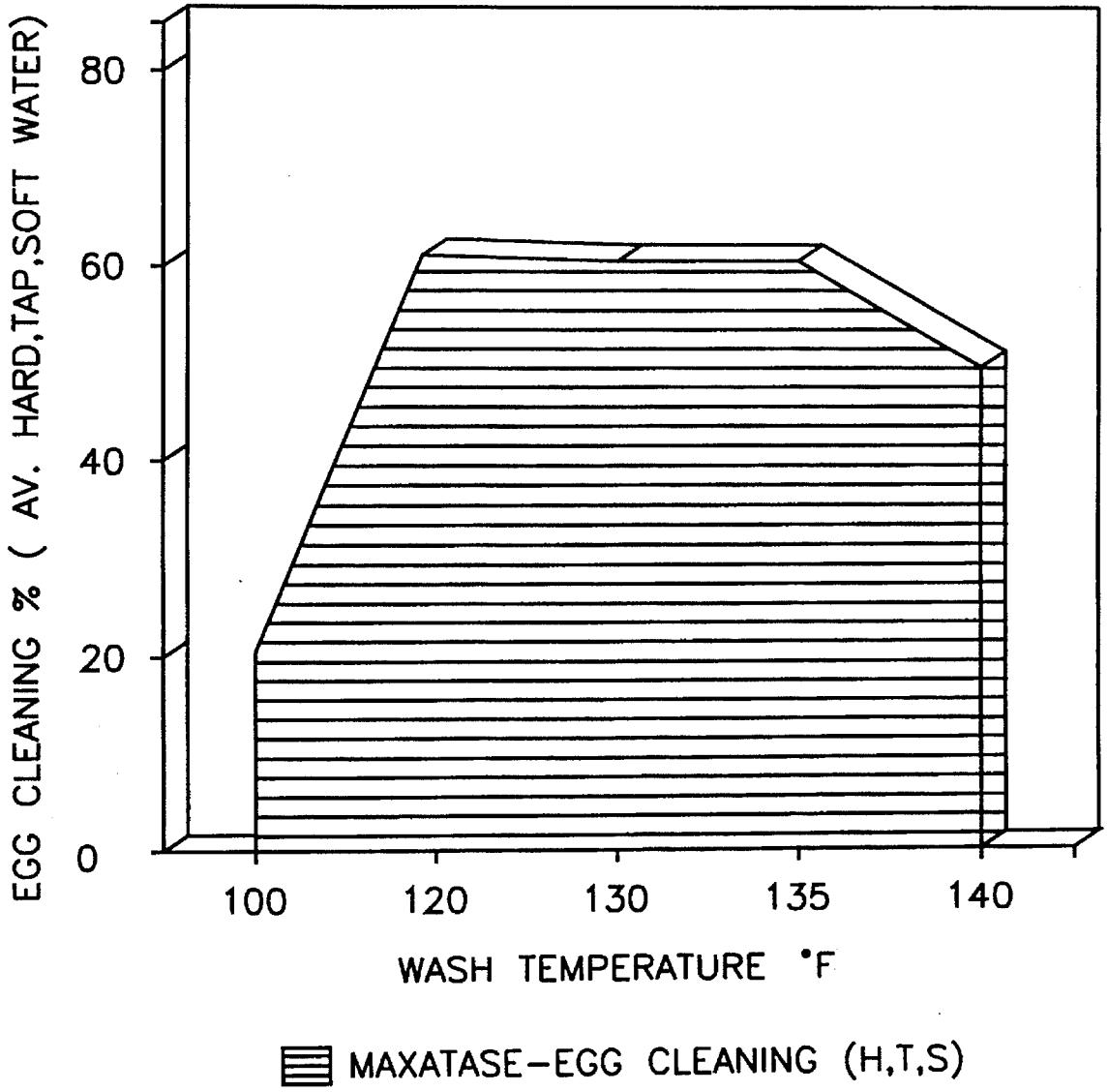
FIG. 2 illustrates a graph of a percent of egg removal at various water and temperature conditions for Maxatase enzyme versus wash temperature of cleaning at a pH of 8.8.
Figure 3:
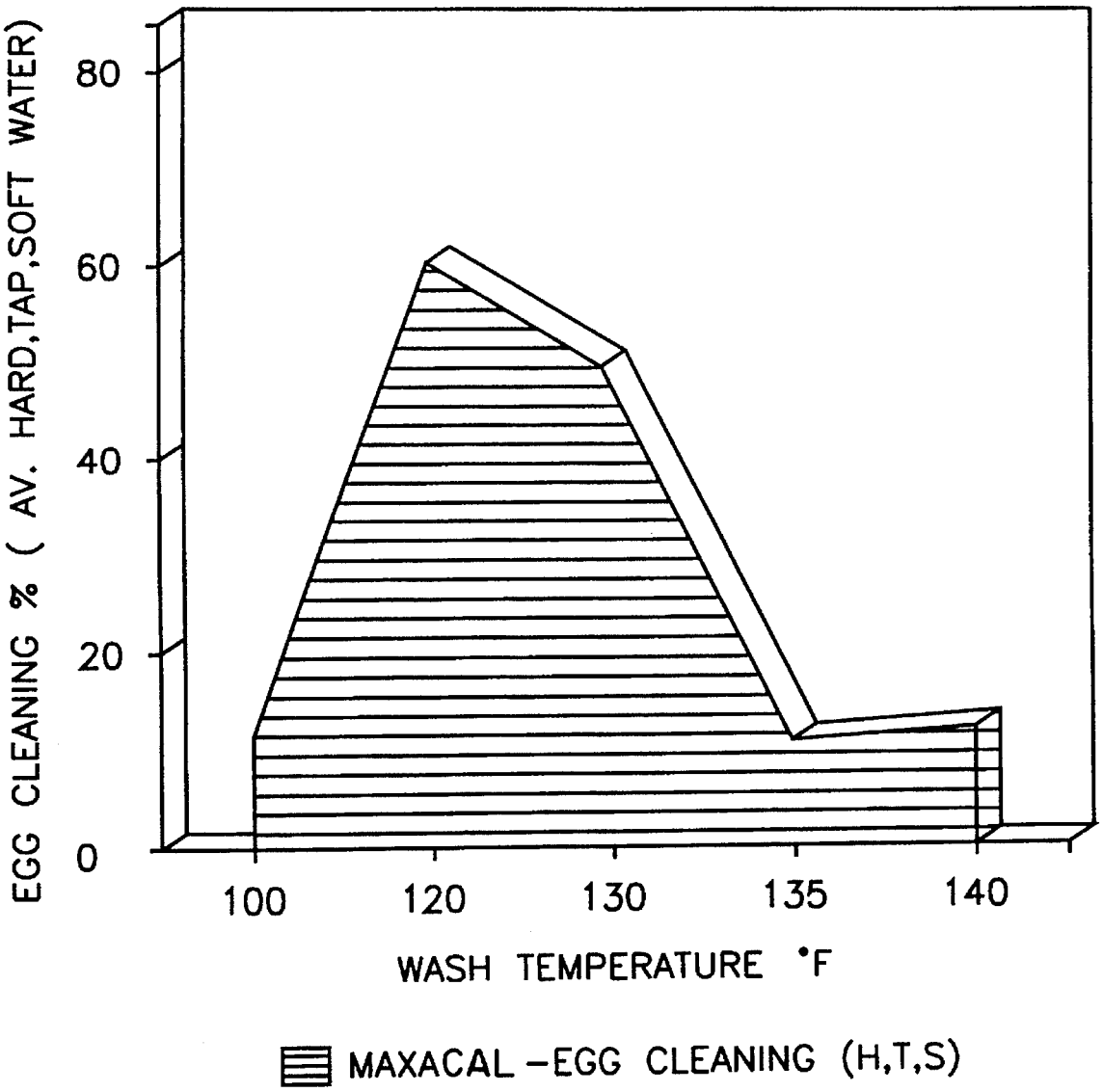
FIG. 3 illustrates a graph of a percent of egg removal at various water and temperature conditions for Maxacal enzyme versus wash temperature of cleaning at a pH of 9.1.
Figure 4:
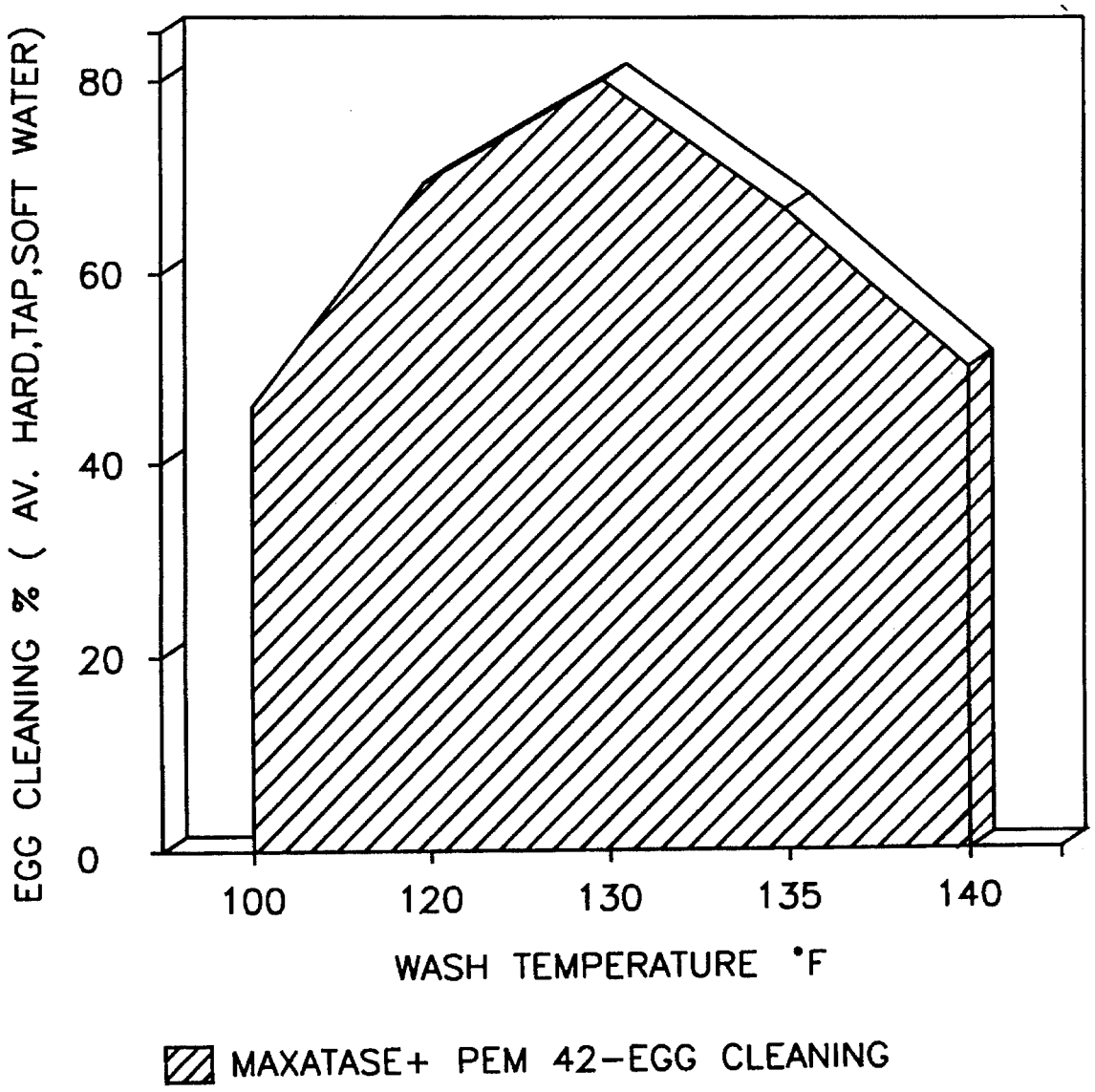
FIG. 4 illustrates a graph of a percent of egg removal at various water and temperature conditions for a combination of Maxatase and Protein Engineered Maxacal 42 (Maxapem 42) enzymes versus wash temperature of cleaning at a pH of 9.1.
Figure 5:
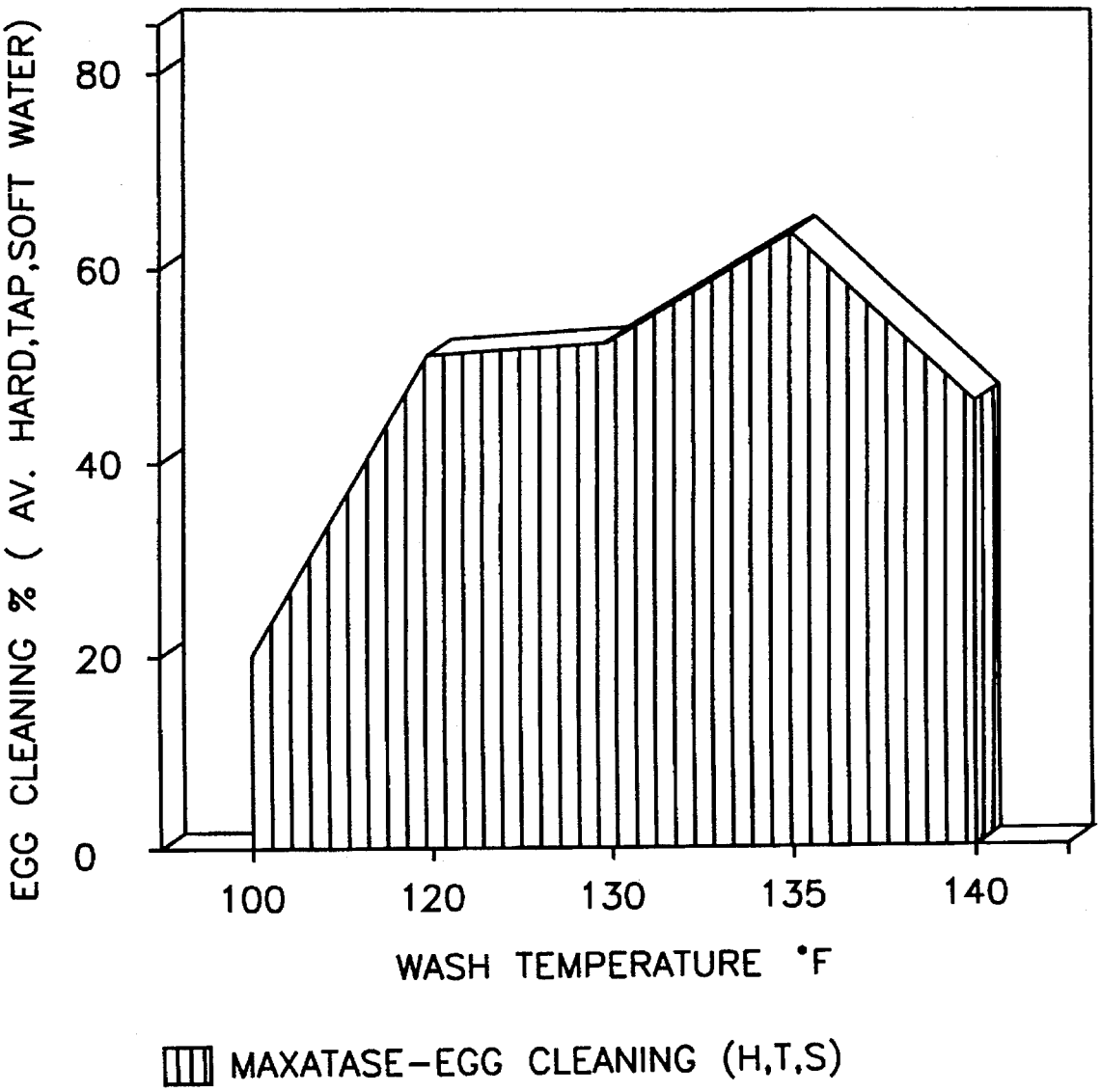
FIG. 5 illustrates a graph of a percent of egg removal at various water and temperature conditions for Maxatase enzyme versus wash temperature of cleaning at a pH of 9.1.

Laboratory performance of the compositions of the Examples were carried out using multi-soils at various temperatures and water hardness conditions. This is done to show differences between the prototype formulations. Egg soil was prepared by mixing egg yolk with an equal amount of 2.5N calcium chloride solution. 0.4 grams of this mixture was applied as thin cross-wise film to the usable surface of 7.5 inch china plates. The plates were aged in 50% relative humidity overnight. Oatmeal soil was prepared by boiling 24 grams of Quaker Oats in 400 ml of tap water for ten minutes. 3 grams of this mixture was spread as thin film onto a 7.5 inch china plate. The plates were aged for 2 hours at 80° C. (176° F.). They were then stored overnight at room temperature. Two plates of each egg and oatmeal were used per wash. The plates were placed in the same positions in the dishwasher. 25 grams of the detergent was used as a single dose per wash. All plates were scored by measuring the percent area cleaned. The multi-soil cleaning test results are reported below. The results tabulated were average of at least 2 runs. Average results reflect the average performance results obtained in three different water conditions in given temperatures and the overall average showed the average results obtained in five temperature in three different water conditions and these results were also shown graphically in FIGS. 1–5.

EXAMPLE 5

The following gelled automatic dishwashing detergent compositions were formulated from the following ingredients in the amounts specified by the previously identified preferred process for forming the composition.

| | H | I |
|---|---|---|
| PEG 300 | 46.5 | 51.4 |
| Propyleneglycol | 4.9 | 4.9 |
| Klucel | 0.1 | 0.1 |
| Poly-Tergent (R) P17A | 6 | 6 |
| Britsil disilicate | 13 | 13 |
| Sodium citrate | 10 | 10 |
| Soda ash FMC 100 | | 8 |
| Good-Rite K759 | 2 | 2 |
| Acusol 460ND | 6 | 6 |
| Maxacal Prill | 2.5 | 2.5 |
| Maxamyl Prill | 1 | 1 |
| | 100 | 100 |
| Viscosity | 9800 | 8500 |
| Physical appearance | gel | gel |
| Stability 3 week separation | stable | stable |

The results show that formulas A and C-I of Example 5 which employ the thickening system of propylene glycol and Klucel form non-aqueous gels. Sample B of Example 5 which does not use either Klucel H nor propylene glycol does not yield a gel product. The formula B, is a liquid suspension which undergo phase separation at R.T. prior to 21 days whereas samples A and C–G of Example 5 which form gels which do not separate at room temperature after three weeks. Sample A and B of Example 4 are liquid suspensions.

The samples were prepared by first forming a 2.0 wt. percent solution/Klucel HF in propylene glycol by heating the propylene glycol to 70%c and then with slow stirring mixing the Klucel HF into the propylene glycol. The solution was cooled and a portion of the cooled solution was mixed into the polyethylene glycol which had been heated to 70% c and stirring was continued with stirring until homogeneity had been achieved the balance of the ingredients were added with mixing in the order as listed in the table to form the composition which was then cooled.

EXAMPLE 6

Other compositions formed by the process of Example 5, incorporated the PM (propylene glycol methyl ether) and the DPnB (dipropylene glycol n-butyl ether) instead of the DPM and the PnB.

| | A | B | C | D | E | F | G |
|---|---|---|---|---|---|---|---|
| Polyethylene Glycol PEG300 | Bal | Bal | Bal | Bal | Bal | Bal | Bal |
| Propylene Glycol | 17.15 | | 14 | 22 | 17.15 | 17.15 | 17.15 |
| Klucel HF | 0.35 | 0 | 0.35 | 0.35 | 0.7 | 1.0 | 0.35 |
| Synperonic LF/D25 | 6.0 | 6.0 | 6.0 | 6.0 | 6.0 | 6.0 | 6.0 |
| Disilicate Hydrated Powder | 10.0 | 10.0 | 10.0 | 10.0 | 10.0 | 10.0 | 10.0 |
| Sodium Tripolyphosphate anhydrous | 30.0 | 30.0 | 30.0 | 30.0 | 30.0 | 30.0 | 30.0 |
| SoKalan CP5 | 5.0 | 5.0 | 5.0 | 5.0 | 5.0 | 5.0 | 10.0 |
| Soda Ash | | | | | | | 11.0 |
| Sodium Citrate | | | | | | | 5.0 |
| Maxacal Prill | 4.0 | 4.0 | 4.0 | 4.0 | 4.0 | 4.0 | 4.0 |
| Maxamyl Prill | 1.0 | 1.0 | 1.0 | 1.0 | 1.0 | 1.0 | 1.0 |
| Stability 3 wk Separation | Stable | unstable | Stable | Stable | Stable | Stable | Stable |
| Physical Appearance | Gel | Liquid Suspension | Gel | Gel | Gel | Gel | Gel |

| Example # | A | B | C | D |
|---|---|---|---|---|
| Polyethylene glycol PEG 300 | Balance | Balance | Balance | Balance |
| Klucel HF | 0.3 | 0.3 | 0.3 | 0.3 |
| PM (c) | 44.2 | | 13.7 | |
| DPnB (d) | | 44.2 | | 13.7 |
| Synperonic LF/D25 | 6.0 | 6.0 | 6.0 | |
| SAG 1000 silicone antifoam | 0.2 | 0.2 | 0.2 | 0.2 |
| Disilicate hydrated powder | 5.0 | 5.0 | 5.0 | 5.0 |
| Sodium tripolyphosphate (anhydrous) | 35.0 | 35.0 | 35.0 | 35.0 |
| Sokalan CP5 | 5.0 | 5.0 | 5.0 | 5.0 |
| Maxacal slurry | 3.5 | 3.5 | 3.5 | 3.5 |
| Maxamyl slurry | 0.8 | 0.8 | 0.8 | 0.8 |
| Stability 2 wks, RT (phase separation in height %) | 6% | 25% | 0% | 0% |

(c) PM = propylene glycol methyl ether (Dow).
(d) DPnB or DPGMBE = dipropylene glycol n-butyl ether (Dow).

What is claimed is:

1. A gelled detergent composition comprising approximately by weight:

(a) 1 to 12 percent of a liquid nonionic surfactant;

(b) 2 to 70 percent of at least one alkali metal detergent builder salt;

(c) 0.1 to 2.0 percent of an antifoaming agent;

(d) 1.5 to 12.0 percent of at least one protease enzyme;

(e) 0.1 to 6.0 percent of an amylase enzyme;

(f) 1 to 20 percent of a low molecular weight non-crosslinked polyacrylate polymer;

(g) 5.0 to 35.0 percent of a stabilizing agent which is a mixture of 5 to 25 weight percent of propylene glycol and 0.1 to 10 weight percent of a hydroxypropylcellulosic polymer; and (h) 35% to 65% of a nonaqueous liquid organic carrier material selected from the group consisting of polyethylene glycol, polypropylene glycol, diethylene glycol monoethyl ether, diethylene glycol monopropylether, diethylene glycol monobutyl ether, tripropylene glycol methyl ether, propylene glycol methyl ether, dipropylene glycol methyl ether, propylene glycol methyl acetate, dipropylene glycol methyl ether acetate, ethylene glycol n-butyl ether and ethylene glycol ether, wherein the composition contains less than about 3.0 wt. % of water and the composition has a Brookfield viscosity at room temperature, #5 spindle at 20 rpms of about 5,000 to about 20,000 cps.

2. The composition a according to claim 1, wherein said composition has a free water content of less than about 3 weight percent and a pH of less than about 11.0.

3. The composition a according to claim 1, further including an alkali metal perborate.

4. The composition a according to claim 3 further including an alkali metal perborate activator.

5. The composition a according to claim 1 wherein said protease enzyme is derived from a bacillus alcalophilus strain.

6. The composition a according to claim 1 wherein said protease enzyme is derived from a bacillus designated PB92.

7. The composition of a according to claim 6 further including said protease enzyme derived from a bacillus alcalophilus strain.

8. The composition a according to claim 1, wherein said composition has a G' value of about 5 to 100 Pa over a 10 to 50% strain range and a G" of about 5 to 100 Pa over a 10 to 50% strain range.

* * * * *